US005421058A

United States Patent [19]

Zahuranec et al.

[11] Patent Number: 5,421,058

[45] Date of Patent: Jun. 6, 1995

[54] HAND-HELD VACUUM CLEANER

[75] Inventors: Terry L. Zahuranec, North Olmsted; David M. Wert, Sagamore Hills, both of Ohio

[73] Assignee: Royal Appliance Mfg. Co., Cleveland, Ohio

[21] Appl. No.: 130,303

[22] Filed: Oct. 1, 1993

[51] Int. Cl.[6] ..... A47L 11/28

[52] U.S. Cl. ..... 15/413; 15/344

[58] Field of Search ..... 15/22.1–22.9, 15/344, 363, 383, 412, 413; 248/342–344, 562, 564

[56] References Cited

U.S. PATENT DOCUMENTS

| | | | |
|---|---|---|---|
| D. 316,399 | 4/1991 | Wharton . | |
| D. 330,700 | 11/1992 | Wharton . | |
| D. 330,887 | 11/1992 | Wharton . | |
| 1,861,261 | 5/1932 | Carson | 15/344 |
| 2,960,713 | 11/1960 | Wistrand . | |
| 2,972,160 | 2/1961 | Hahn | 15/412 |
| 2,974,346 | 3/1961 | Hahn | 15/344 |
| 3,580,588 | 5/1971 | Allen et al. . | |
| 3,865,463 | 2/1975 | Busch . | |
| 4,027,348 | 6/1977 | Flowers | 15/22.1 |
| 4,391,485 | 7/1983 | Urani . | |
| 4,506,400 | 3/1985 | Klein | 15/22.1 |
| 4,547,927 | 10/1985 | Berfield . | |
| 4,586,214 | 5/1986 | Berfield . | |
| 4,633,543 | 1/1987 | Sovis | 15/344 |
| 4,964,398 | 10/1990 | Jones | 15/22.1 |
| 4,988,315 | 1/1991 | Wharton . | |
| 5,005,251 | 4/1991 | McLeod et al. . | |
| 5,073,721 | 12/1991 | Terrill et al. . | |
| 5,129,128 | 7/1992 | Bowerman | 15/344 |
| 5,131,869 | 7/1992 | Wharton . | |
| 5,217,395 | 6/1993 | Bailey et al. . | |
| 5,230,641 | 7/1993 | Wharton . | |

FOREIGN PATENT DOCUMENTS

| | | |
|---|---|---|
| 2208423 | 2/1972 | Germany . |
| 206532 | 9/1984 | Germany . |

*Primary Examiner*—David A. Scherbel
*Assistant Examiner*—Terrence R. Till
*Attorney, Agent, or Firm*—Fay, Sharpe, Beall, Fagan, Minnich & McKee

[57] ABSTRACT

A hand-held vacuum cleaner is disclosed including first and second air intake chambers to accommodate cooling air intake to the vacuum cleaner motor, and an exhaust chamber to accommodate exhausted cooling air from the motor. The motor has a cooling fan which draws cooling air in from both ends of the motor and exhausts it from a middle portion thereof. First and second peripheral baffle walls in a motor mount portion of the vacuum cleaner housing extend towards contiguous engagement with the motor to define air intake and exhaust chambers. A motor mounting plate is fastened to the motor and is secured in the housing by a wedging and binding reception in a slot within the housing.

4 Claims, 3 Drawing Sheets

40
38
38

40
108
22
12
48
46
46
44

42
42
44

100

100
110
116
104

100
104
106
106

HAND-HELD VACUUM CLEANER

BACKGROUND OF THE INVENTION

This invention pertains to the art of vacuum cleaner devices, and more particularly to a hand-held vacuum cleaner.

The invention is particularly applicable as a device for suction cleaning items and places where conventional, larger sized vacuum cleaners are inconvenient and, more particularly, where a hand-held vacuum with a revolving brush that provides a vibrating and sweeping action is useful. U.S. Pat. No. 4,633,543 shows such a hand vac and its disclosure is incorporated herein by reference. The invention is intended for use with a twelve volt motor, such as is typically powered by a conventional automobile battery or generator system.

A principal problem with prior known hand-held vacuums having such a twelve volt motor is the mounting and placement of the motor in the vacuum cleaner housing to accommodate proper cooling of the motor. For example, a conventional twelve volt, nine and one half amp motor which is useful in the subject invention is configured to have the motor commutator at one end of the motor housing and the armature windings at the opposite end of the motor housing. The fan for cooling the motor is typically disposed intermediate of the commutator and armature windings so that the cooling air flow through the motor comprises drawing air in through the opposite ends over the commutator and windings, respectively, and then exhausting it through the middle of the motor housing at the fan location. This differs from a more usual motor configuration in which the cooling exhaust fan is at one end of the cleaner, not in the middle.

A particular problem presented by use of such an electrical motor that can be powered by a car battery is to accommodate the cooling air needs of the motor while maintaining a clear and unobstructed working air channel for the passage of dirt laden working air from the nozzle through to a bag or collector assembly. The problem entails not only maintaining proper separation of the working air from the cooling air, but also ensuring that the cooling air is properly directed so as not to intermix cooling air intake and cooling air exhaust.

Another common problem with hand-held vacuum cleaners is proper mounting of the motor within the vacuum cleaner housing. In particular, since the motor operates a relatively large fan, the fan must be locked against rotation within the housing and positioned in a secure disposition within the housing to properly operate the fan, avoid obstructing the working air channel, avoid electrical short-circuiting or shock to a user of the cleaner and minimize vibrations and noise generated therefrom. Most conventional cleaners simply use fastening devices to fasten the motor housing to the vacuum cleaner housing. However, in a highly automated assembly operation, the use of such fastening devices directly between the motor and the housing is undesirable both from the time efficiency of the assembly operation itself and from the difficulty and cost in using multiple fasteners to secure a motor to the housing.

The present invention contemplates a new and improved hand-held vacuum cleaner which overcomes the above referred to problems and others to provide a new hand-held vacuum which is particularly useful as a car vacuum to be powered by the car battery or generator and which provides improved hand-held vacuum cleaner operation with respect to motor cooling and unit assembly.

BRIEF SUMMARY OF THE INVENTION

In accordance with the present invention, there is provided a hand-held vacuum cleaner having a housing, a rotating brush and a selectively separable bag assembly. The housing contains a motor and fan for drawing in air from a housing nozzle. The fan is mounted on the motor shaft in a fan chamber disposed for drawing the working air in from the nozzle into the fan and chamber and into the bag through an unobstructed working air channel.

It is a particular feature of the present invention that the housing includes a motor mount shell portion including a plurality of baffle walls extending radially from the motor towards the housing outer wall to define air intake and exhaust chambers relative to the motor. The housing outer walls include air inlet slots and air outlet slots spaced about the baffle walls whereby the motor cooling air is kept separated from vacuum working air and wherein the cooling air is drawn in the air inlet slots and expelled from the air outlet slots without mixing in the respective intake or exhaust chambers.

In accordance with another aspect of the invention, the motor is retained in the motor mount shell portion with a retaining means in the form of a slot adapted to receive a cooperating mounting plate releasably joined to the motor. The slot and plate are matingly tapered to wedge and bind together at their assembly. Accordingly, although the motor is fastened to the mounting plate with fastening devices, the motor may be assembled into the motor housing without the need of additional fasteners. The mounting plate further includes a locating and centering collar for properly positioning the motor and mounting plate within the motor mount portion of the vacuum cleaner housing.

One benefit obtained by use of the present invention is a hand-held vacuum which is particularly useful as a car vacuum.

Another benefit is a hand vacuum which has improved motor cooling air passageways through the housing.

A further benefit of the present invention is a hand vacuum in which the vacuum assembly is eased by assembly of the motor within the housing by a slot and mounting plate cooperating retaining device.

Other benefits and advantages for the subject new hand vacuum will become apparent to those skilled in the art upon a reading and understanding of the specification.

BRIEF DESCRIPTION OF THE DRAWINGS

The invention may take physical from in certain parts and arrangements of parts, the preferred embodiments of which will be described in detail in this specification and illustrated in the accompanying drawings which form a part hereof and wherein.

DETAILED DESCRIPTION OF THE INVENTION

Figure 1:
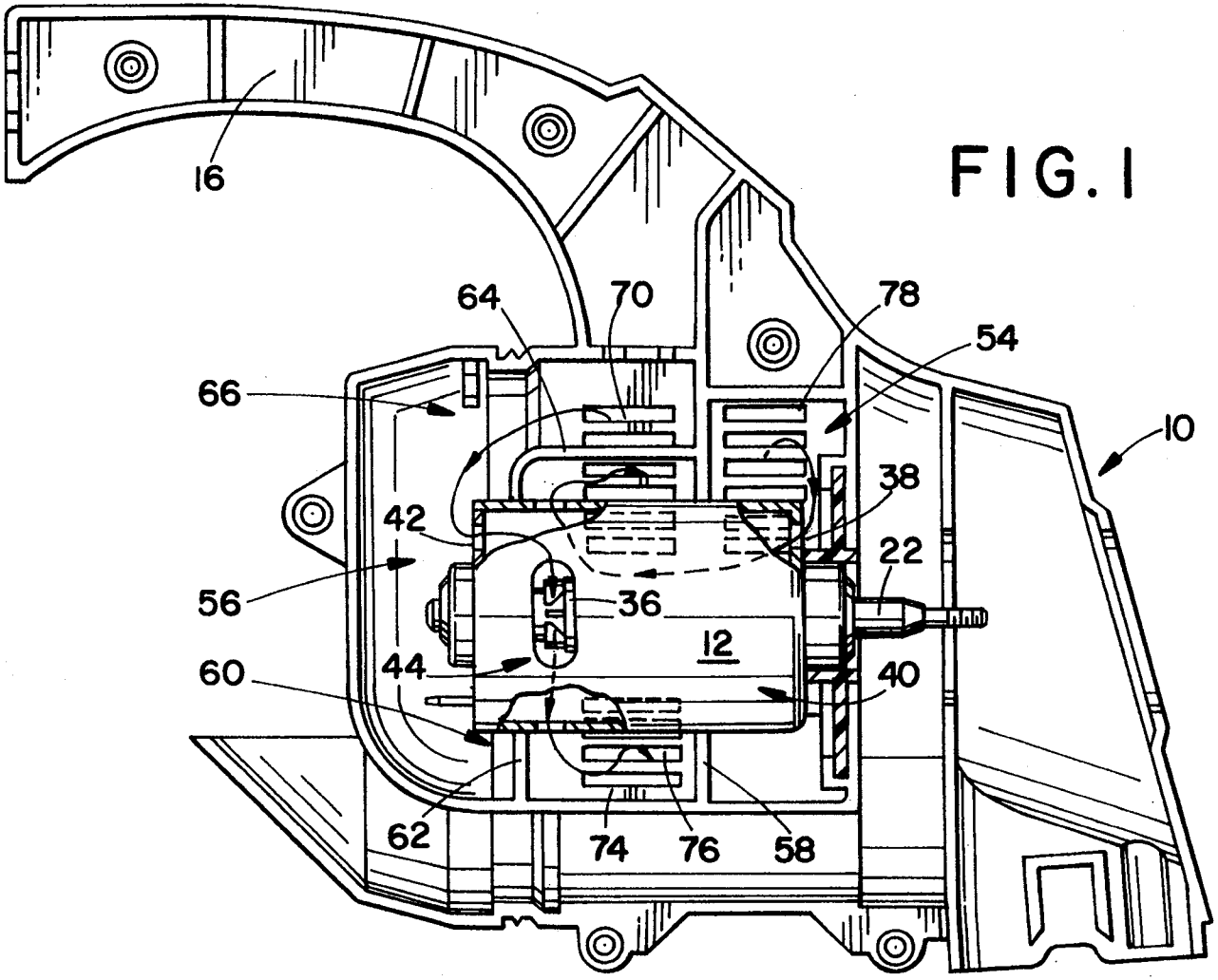
FIG. 1 is a cross-sectional view of the hand-held vacuum cleaner housing showing a half-shell of the housing, including the motor mounted therein and with illustrative arrows showing cooling air flow paths through the housing and motor.
Figure 2:
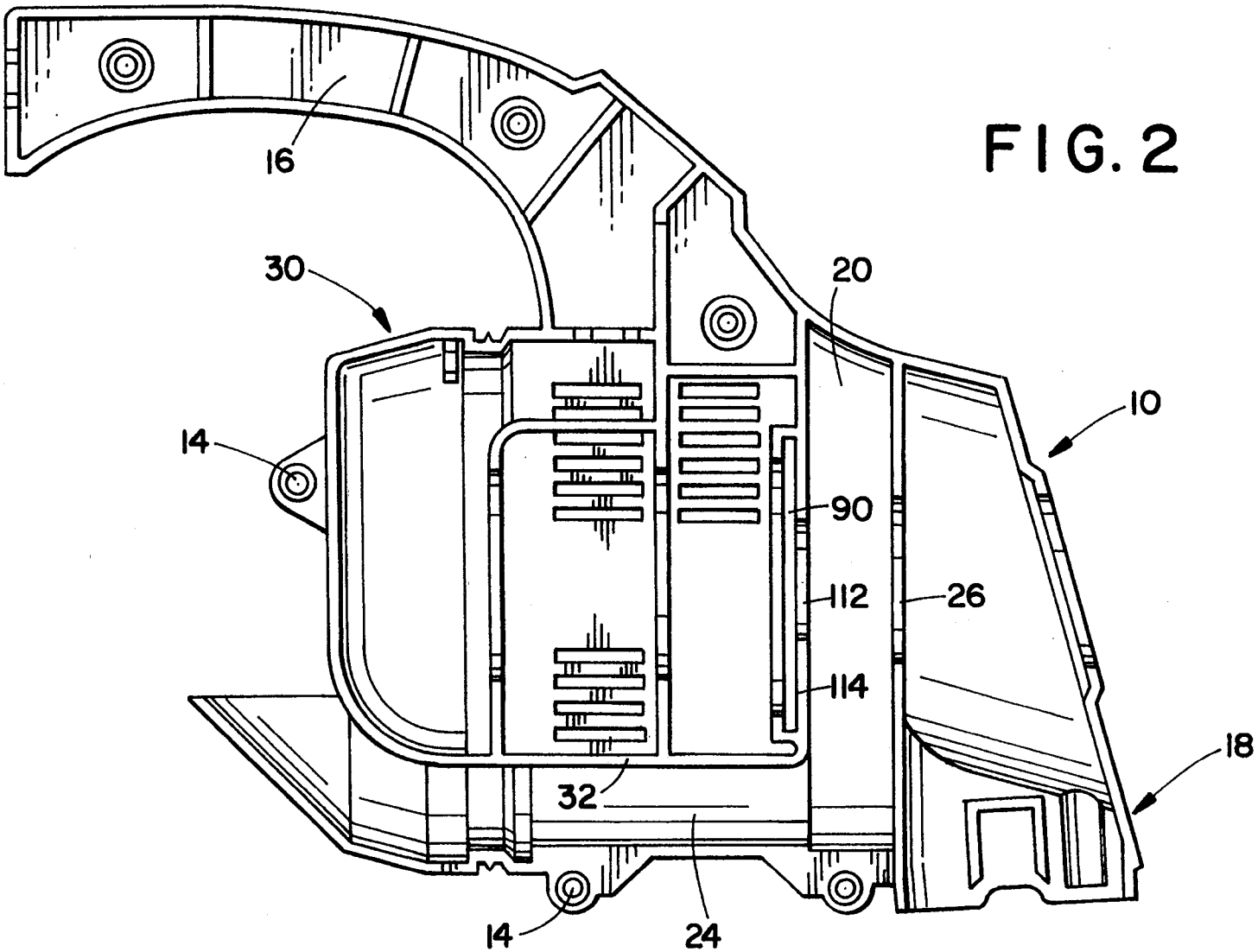
FIG. 2 is a cross-sectional view corresponding to the half-shell of the housing shown in FIG. 1, but lacking the motor mounted therein.

Referring now to the drawings wherein the showings are for purposes of illustrating the preferred embodiments of the invention only, and not for purposes of limiting same, the FIGURES show a hand-held vacuum device comprised of a housing 10 for containing a motor 12. More specifically, as noted above, the hand-held vacuum is primarily intended for use as a car vacuum in that in its preferred embodiment, the motor 12 comprises a twelve volt motor such as can be powered by a car battery or generator system through the automobile cigarette lighter. With particular reference to FIGS. 1 and 2, the housing 10 is comprised of mirror image half elements which are fastened together with conventional fastening devices at fastener receptacles 14. For purposes of illustration only one of the housing elements is shown in FIGS. 1 and 2, although it should be appreciated that the illustration of a second half housing would be merely the mirror image thereof. The housing has a handle 16 and a nozzle 18. A fan chamber 20 houses a fan (not shown) that is received on a shaft 22 of the motor 12. Depending from the fan chamber 20 is a working air channel 24 which communicates dirt laden air to a selectively separable bag assembly (not shown). The complete flow path for the working air is through the nozzle 18, through nozzle wall opening 26, through the fan chamber 20, through the working air channel 24 and ultimately into the receptacle or bag. It is an important feature of the invention that the working air channel be as little obstructed as possible by other structural features of the cleaner.

Another principal feature of the housing 10 is a motor mount portion 30 structured for receiving the motor 12 and sealed from the working air channel 24 by a motor mount portion peripheral wall 32.

Figures 3, 4, 5, 6, 7, 8:
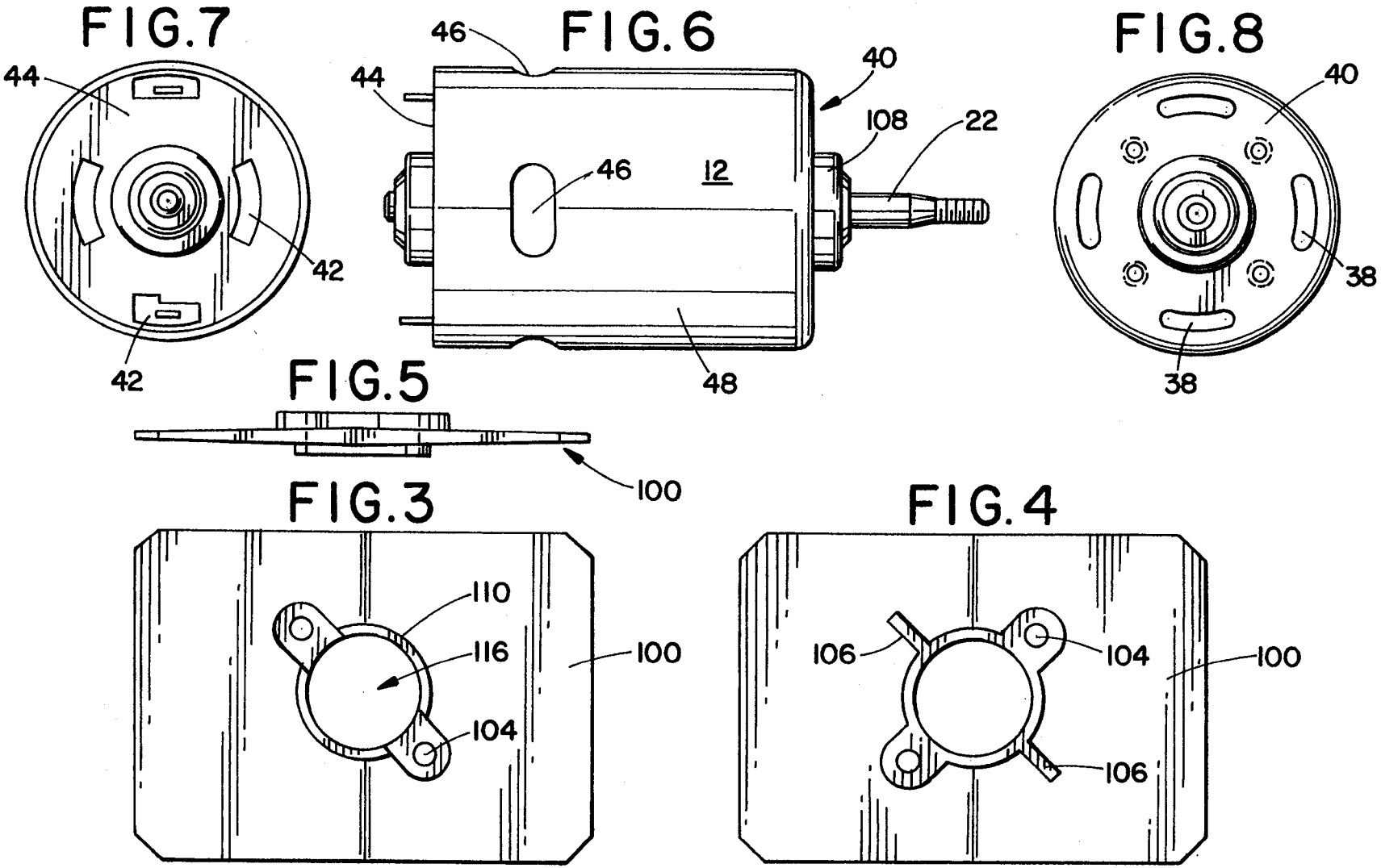
FIG. 3 is an elevational view of a front side of a mounting plate for mounting the motor in the housing.
FIG. 4 is a rear elevational view of the mounting plate of FIG. 3.
FIG. 5 is a side view of the mounting plate of FIG. 3.
FIG. 6 is an elevational view of the motor shown in FIG. 1.
FIG. 7 is a rear view of the motor of FIG. 6, particularly showing the air inlet passageways to the motor; and, FIG. 8 is a front elevational view of the motor of FIG. 6, also illustrating air inlet openings.

With particular reference to FIG. 1, cooling air flow paths through the housing 10 and motor 12 are diagrammatically illustrated. The motor includes a cooling fan 36 which causes cooling air to be drawn in through front inlet vents 38 at the motor front end 40 and through rear inlet vents 42 at the motor rear end 44, as better seen in FIGS. 6, 7 and 8. The fan exhausts the cooling air through exhaust vents 46 in the motor sidewall 48. Cooling air is drawn through the front inlet vents 38 from the housing first cooling air intake chamber 54 and through rear inlet vents 42 from a second cooling air intake chamber 56. The first and second cooling air intake chambers are separated by a first peripheral baffle wall 58 extending radially from the motor towards integral formation with a housing outer wall and the motor mount portion peripheral wall 32. The wall 58 is in contiguous engagement to said motor at the motor sidewall 48 to assure air separation between the air chambers. A second peripheral baffle wall 60 similarly defines the second cooling air intake chamber 56 and includes a first portion 62 that extends radially from the motor sidewall 48 out to the housing outer sidewall and motor mount wall 32, and a second portion 64 which is turned to extend in a generally tangential direction to the motor sidewall 56 to define an air inlet passageway 66 from housing outer wall inlet vents 70 to the motor rear end inlet vents 42. The effect of the configuration of the first and second peripheral baffle walls 58, 60 is that the motor mount portion has two distinct intake channels. First and second peripheral baffle walls 58, 60 thereby also define the motor cooling air exhaust chamber 74 whereby cooling air exhausted from the motor exhaust vents 46 may be expelled from the housing through housing air outlet vents 76. Thus, in a same space where merely two air chambers were included (note the '543 patent referenced above) the invention has three air chambers.

The cleaner includes in the housing sidewall first cooling air intake chamber inlet vents 78 adjacent the first cooling air intake chamber 54, second cooling air intake chamber inlet vents 70 adjacent the second cooling air intake chamber 56, and housing sidewall cooling air exhaust vents 76 adjacent the cooling air exhaust chamber 74. It is an advantageous feature of the structure of the present invention that cooling air can be ducted to inlet vents at both the front and rear end of the motor 12 and exhausted from a middle portion of the motor in a manner that the cooling air intake and exhaust are not mixed and that the air flow pattern is such that the working air from the nozzle is unobstructed.

With particular reference to FIG. 2, the first cooling air intake chamber 54 includes an integral slot 90 sized for receiving mounting plate 100 (FIGS. 3–5) for mounting and supporting the motor and driving shaft 22 in the housing 10. The slot 90 comprises a generally U-shaped envelope sized to guide the edge portions of the mounting plate 100 into the appropriate position within the housing 10. As can be seen from the FIGURES, the mounting plate 100 is generally rectangular and is adapted to fit into the slot. The plate supports the motor by means of conventional fastening devices through fastener openings 104. The motor is thus secured on one side of the plate, while the motor shaft extends through the plate and supports a fan (not shown) on the other side of the plate. The mounting plate thus prevents the motor from spinning, mounts the motor to the motor housing and seals the first intake chamber 54 from the fan chamber 20 via a labyrinth seal formed by the cooperation of the two walls of the slot in the mounting plate mounted in the slot. The mounting plate is slightly spaced from the front end 40 of the motor by spacer ribs 106, so that cooling air can flow to the front cooling air inlet vents of the motor. The slot 90 and plate 100 are matingly tapered (note FIG. 5) so that they cooperate to wedge and bind together when assembled. The centering of the motor shaft is effected by reception of a motor shaft housing flange 108 in contiguous engagement against a locating and centering collar 10 disposed to engage an opening 112 in a wall 114 of the fan chamber 20. In other words, the mounting plate include a fan shaft portal 116 sized for contiguous engagement to the motor shaft housing flange 108 and the portal includes a locating and centering collar disposed to engage the opening in the fan chamber wall of the housing and position the motor shaft relative to the fan chamber. It thus can be seen that the motor can be secured in the housing without use of fasteners between the motor itself and the housing itself. Rather, fasteners are used to fasten the mounting plate to the motor before housing assembly so that the housing assembly can be accomplished by dropping the motor and mounting plate into the baffle walls in slot 90 and then fastening the two housing elements together for quick and easy assembly.

The invention has been described with reference to the preferred embodiments. Obviously, modifications and alterations will occur to others upon a reading and understanding of the specification. It is our intention to include all such modifications and alterations in so far as they come within the scope of the appended claims or the equivalents thereof.

Having thus described the invention, we now claim:

1. A hand-held vacuum cleaner including a housing comprising mating first and second half housing elements, said housing having a handle and a nozzle, a motor having a cooling fan for drawing cooling air through the motor, a working air channel for communicating working air from said nozzle to out of said housing, and a motor mount portion receiving said motor and sealed from said working air channel by a motor mount portion peripheral wall;

said motor mount portion including first and second cooling air intake chambers, a motor cooling air exhaust chamber and a first and second peripheral baffle walls extending from a housing outer wall to contiguous engagement to said motor to define said intake chambers and said exhaust chamber, said housing outer wall including a plurality of air inlet vents at said cooling air intake chambers, for cooling air inflow to said motor, and a plurality of air outlet vents at said cooling air exhaust chamber, for cooling air exhaust from said motor through said housing elements, said inlet and outlet vents being oppositely spaced about said baffle walls, said cooling fan for drawing cooling air through the motor causing the cooling air to enter said inlet vents and chambers and exit the outlet chamber and vents.

2. The hand-held vacuum cleaner as defined in claim 1 wherein the second peripheral baffle wall has a first portion extending radially from the motor towards integral formation with a housing side wall and a motor mount portion peripheral wall, and a second portion depending from the first portion and extending tangentially to the motor towards integral formation with the first peripheral baffle wall.

3. A hand-held vacuum cleaner including a housing comprising mating first and second half housing elements, said housing having a handle and a nozzle, a motor having means for drawing cooling air through the motor, a working air channel for communicating working air from said nozzle and a motor mount portion receiving said motor and spaced from said working air channel by a motor mount portion peripheral wall;

said motor mount portion including a motor retaining member comprising a mating plate and slot assembly wherein the mounted plate is releasably joined to the motor and received in the slot at assembly, the mounting plate further including a fan shaft portal sized for contiguous engagement to a motor shaft housing flange and including a locating and centering collar disposed to engage an opening in fan chamber wall of the housing and position the motor shaft relative to a fan chamber in the housing.

4. The hand-held vacuum cleaner as described in claim 3 wherein the slot and plate are matingly tapered to wedge and bind together at assembly.

* * * * *